US008664869B2

(12) United States Patent
Grebner et al.

(10) Patent No.: US 8,664,869 B2
(45) Date of Patent: Mar. 4, 2014

(54) METHOD FOR CONTROLLING AN ELECTRICAL LOAD

(75) Inventors: Klaus-Dieter Grebner, Markt Rodach (DE); Michael Reier, Pressig (DE)

(73) Assignee: Lear Corporation GmbH, Kronach (DE)

( * ) Notice: Subject to any disclaimer, the term of this patent is extended or adjusted under 35 U.S.C. 154(b) by 347 days.

(21) Appl. No.: 13/044,926

(22) Filed: Mar. 10, 2011

(65) Prior Publication Data

US 2011/0221352 A1 Sep. 15, 2011

(30) Foreign Application Priority Data

Mar. 10, 2010 (DE) ..... 10 2010 015 904

(51) Int. Cl.
*H05B 37/00* (2006.01)

(52) U.S. Cl.
USPC ..... 315/186; 315/306; 315/360

(58) Field of Classification Search
USPC ..... 315/185 R, 186, 188, 291, 306, 307, 315/360, 119
See application file for complete search history.

(56) References Cited

U.S. PATENT DOCUMENTS

| | | | | |
|---|---|---|---|---|
| 7,688,002 | B2 * | 3/2010 | Ashdown et al. | 315/291 |
| 8,120,289 | B2 * | 2/2012 | Vaassen et al. | 315/362 |
| 8,164,276 | B2 * | 4/2012 | Kuwabara | 315/294 |
| 2008/0203946 | A1 * | 8/2008 | Ito et al. | 315/307 |
| 2009/0251065 | A1 | 10/2009 | Niedermeier et al. | |
| 2010/0013411 | A1 | 1/2010 | Krespach et al. | |
| 2011/0068702 | A1 * | 3/2011 | van de Ven et al. | 315/186 |

FOREIGN PATENT DOCUMENTS

DE 202007011973 U1 1/2009

* cited by examiner

*Primary Examiner* — Tung X Le
(74) *Attorney, Agent, or Firm* — MacMillan, Sobanski & Todd, LLC

(57) ABSTRACT

A method for controlling an electrical load of at least two single loads includes activating and deactivating the single loads in switching cycles of predefined duration sequentially following one another. In one switching cycle, the single loads are activated and deactivated alternately with respect to one another.

9 Claims, 8 Drawing Sheets

METHOD FOR CONTROLLING AN ELECTRICAL LOAD

BACKGROUND OF THE INVENTION

The present invention relates to a method for controlling an electrical load. The controlled electrical load particularly relates to an arrangement of light-emitting diodes, hereinafter called LEDs, wherein the electrical load must be supplied with a nearly constant operating current.

Constant current sources are preferably used for controlling an electrical load, especially LEDs, LED chains and/or LED arrays. Diverse arrangements of LEDs are known. Besides the parallel arrangement or matrix connection of LEDs, the possibility of series connection of LEDs is also known. In the series connection of LEDs, all LEDs are connected behind one another in a row; this connection is also called an LED chain. To operate such LED chains, a constant current is generated and conducted through the LEDs. A voltage that corresponds to the sum of the forward voltages of all LEDs then arises across the LEDs.

In order to achieve a constant luminous efficiency, the current that flows through the LEDs must be controlled temperature-dependent and be nearly constant. This is achieved in a well-known manner through pulse-width modulation of the supplied current. By means of pulse-width modulation, this modulated current is then used for the brightness control of the LED chain. The energy supply of the LEDs is accomplished by a step-up converter, for example.

An LED cluster arrangement, which is supplied with constant current, is known from DE 20 2007 011 973 U1. The LED cluster arrangement is controlled by pulse-width modulation.

DE 2006 059 355 A1 discloses a control device in a method for operating a series connection of light-emitting diodes.

DE 10 2005 058 484 A1 discloses a circuit arrangement and a method for operating at least one LED.

Voltage and current variations that stress the energy supply unit particularly arise during switching operations in LED chains, such as switching on/off single LEDs connected in series. The forward voltage, which drops at the LED for a corresponding current, is based on the current-voltage characteristic of a light-emitting diode. A particular minimum voltage is thus first necessary for operation. The LED current is nearly negligible until this minimum voltage is reached, and the light emission is zero or nearly zero.

If the brightness emission of individual LEDs, which are connected in series and together form one or more light sources, is to be influenced, this is accomplished by jumping several of the LEDs using a switch arranged in parallel to each LED or to an LED group. The switch is advantageously embodied in the form of a semi-conductor switch. The current then flows either through the LEDs whose parallel switch is open or through the closed switches. This switching principle allows the LEDs connected in series to be switched on and off as desired. As long as the number of LEDs remains constant, i.e. a switching operation does not change the number of LEDs switched on, the output voltage that the voltage supply unit must provide will remain unchanged. However, changing the simultaneously driven LEDs presents a problem, because the output voltage needed to operate the new number of LEDs changes and the LED current thus breaks down. If one LED among the operated or already illuminating LEDs is now switched on or off, a considerable voltage peak and a current variation appears. When switching on an LED, a current break therefore occurs at first due to the lack of output voltage and then a voltage peak occurs due to the control response.

The result is that the LEDs that are already switched on and illuminating at first become dark and flicker. This must be avoided through a suitable control.

It is therefore the object of the invention to provide a method that handles this problem without using additional components or devices.

SUMMARY OF THE INVENTION

The present object is achieved on the basis of the characteristics of the claims. Advantageous embodiments of the invention arise on the basis of the dependent claims, the further description and from concrete example embodiments based on the figures.

The method according to the invention serves to control an electrical load. The electrical load consists of at least two single loads connected in series. The single loads are switched on and off within switching cycles of predefined duration sequentially following one another. A controllable switch is connected in parallel to each single load so that each single load can be switched independently of the other single load within one switching cycle. The electrical current, which is supplied by a driver stage and flows in the electrical load, is monitored and, by means of a target-performance comparison, adjusted to an adjustable setpoint by a control unit, so that a current that is as constant as possible flows in the electrical load. By means of the controllable switch, the control unit can switch each of the single loads on and off within the switching cycle at predefined turn-on and turn-off times. In a switching cycle in which the number of single loads to be switched on and the number of single loads to be switched off are equal, always the same number of single loads is switched on and the same number of other single loads is switched off simultaneously. In a switching cycle in which the number of single loads to be switched on is larger than the number of single loads to be switched off, the switching cycle is extended by a correction period, wherein the correction period nearly corresponds to the period that the control unit needs to bring the output current of the driver stage to the desired current when a load surge appears. A load surge arises from switching on a single load without shutting off another single load at the same time. The time positions of the predefined turn-on times and turn-off times of the single loads are then varied or remain the same as a function of the time of the load surge in the switching cycle, and/or their ON times are extended or reduced or else they remain the same. If the cycle time is extended, then it is also possible that the switching points of already driven loads will change because of the predetermined duty factor.

It is advantageous to compensate a load surge or load surges that arise when switching on one or more single loads. The compensation proceeds in such a manner that alternatively always the same number of single loads is switched on and the same number of other single loads is switched off. This nearly prevents a load surge, because the voltage dropping on the electrical load remains nearly constant. But a requirement is that the two loads have nearly identical electrical parameters. In an alternative embodiment, if the single loads are configured in the form of light-emitting diodes, the light output of the light-emitting diodes connected in series is determined. The reduction in the light output caused by a load surge is then determined and the predicted reduction of the light output during a switching cycle is then compensated by extending the switching cycle and switching on the individual light-emitting diodes for a longer or shorter period of time so that the brightness emission will then approximately correspond to that which the light-emitting diodes would have emitted without load surge.

According to the embodiment as per claim 2, it is preferred that the correction time that arises in a switching cycle with load surge is also completed in a switching cycle without load surge. All uncorrected ON durations of the loads will thus relate to the same cycle duration. For switching cycles without a load surge, this means that the load is driven shortened by the correction time. No brightness differences between switching cycles with and without load surge thus arise, because the activation ratio is identical.

According to the embodiment as per claim 3, it is preferred that the switching cycle from the beginning of the load surge until the end of the switching cycle is divided into time units and that the adaptation of the turn-on and turn-off times is based on the time units.

According to the embodiment as per claim 4, it is preferred that the time units have the same period.

According to the embodiment as per claim 5, it is preferred that the time units correspond to an equivalent energy.

According to the embodiment as per claim 6, it is preferred that the duration of the activation of a single load is extended or reduced as a function of the time position of the load surge during the switched-on state of the single load. It is thus possible to adapt the amount of light emitted by a single load configured as light-emitting diodes in one switching cycle on the basis of a selective extension or reduction of the duration of the activation of that single load on the basis of time units. The division into time units makes it possible to controllingly intervene in relation to the load surge and thus correct the light output of a single load over the switching cycle.

According to the embodiment as per claim 7, it is preferred that the control unit performs the initial switch-on and/or the switching off of the at least two single loads of the electrical load individually, sequentially or together or in groups.

According to the embodiment as per claim 8, it is preferred that the control unit uses a current measuring unit to monitor the electrical current flowing in the electrical load at a current measuring point and, by means of a target-performance comparison, uses the driver stage to adjust said electrical current to an adjustable setpoint so that a current that is as constant as possible flows in the electrical load.

According to the embodiment as per claim 9, it is preferred that a single load is a diode array consisting of a light-emitting diode or at least two light-emitting diodes connected in parallel and/or connected in series and/or matrix-connected.

It is also advantageous if the control unit is formed from a microprocessor unit or a microcomputer unit or microcontroller unit or a microelectronic unit with a constant operating voltage.

The invention will be further described in more detail below on the basis of a concrete example embodiment based on FIGS. 1-8. This description of the invention on the basis of concrete example embodiments does not represent any limitation of the invention to one of the example embodiments. In the example embodiment, the single loads are configured as light-emitting diodes, hereinafter called LED or LEDs.

Various aspects of this invention will become apparent to those skilled in the art from the following detailed description of the preferred embodiment, when read in light of the accompanying drawings.

DETAILED DESCRIPTION OF THE PREFERRED EMBODIMENT

Figure 1:
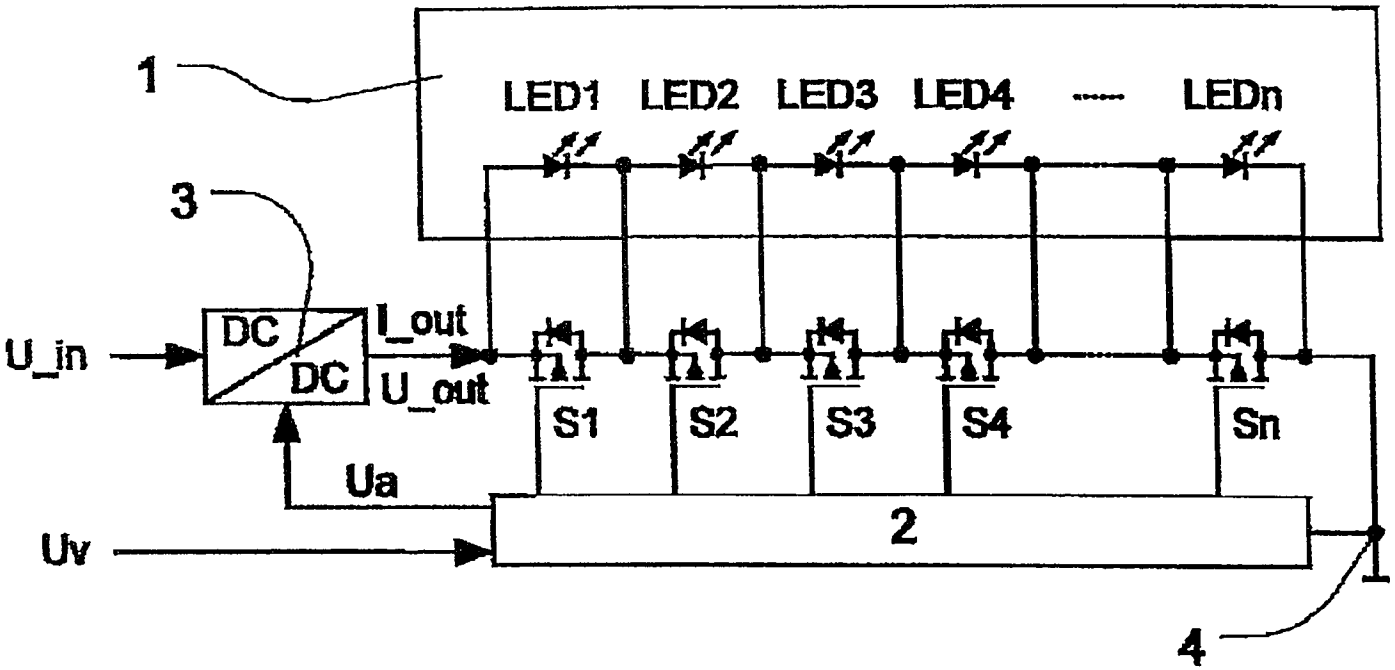
FIG. 1 is a well-known circuit principle for LEDs.

In the following description of the figures, throughout the figures the same reference character will be used in all figures for identical elements in the respective figures. This serves for clarity and better understanding of the further concrete description of the invention based on figures FIG. 1 to FIG. 8.

FIG. 1 depicts a circuit arrangement for controlling light-emitting diodes. An electrical load 1 is illustrated. The electrical load 1 consists of the single loads LED1, LED2, LED3, LED4 to LEDn, which are configured as light-emitting diodes. These light-emitting diodes LED1, LED2, LED3, LED4 to LEDn are connected in series. Each of the single loads LED1, LED2, LED3, LED4 to LEDn represents at least one light-emitting diode.

Light-emitting diodes, especially those with high power, are usually connected in series, operated connected in series and supplied with a constant voltage. The power supply is achieved through a driver stage 3. This driver stage 3 is embodied at least as a constant-current source, preferably in the form of a switching regulator or a DC/DC converter with a constant current output.

Taking the voltage-current characteristic of a light-emitting diode into consideration, there arises a forward voltage, which drops at the light-emitting diode for a corresponding current. Thus a particular minimum voltage is first required for the operation of a light-emitting diode. For light-emitting diodes connected in series, this minimum voltage depends on the number of light-emitting diodes LED1 to LEDn connected in series. The current I_out, which flows through the light-emitting diodes LED1 to LEDn, is nearly negligible until this minimum voltage is reached and the light emission from the light-emitting diodes LED1 to LEDn is nearly zero. If the brightness, i.e. the brightness emission, of the individual light-emitting diodes LED1 to LEDn arranged in the series connection is to be influenced, then one of the light-emitting diodes LED1 to LEDn of the electrical load 1 must be jumped. The jumping is performed in such a manner that each of the light-emitting diodes LED1 to LEDn is respectively connected in parallel to one switch S1 to Sn. Closing the switch S1 to Sn respectively assigned to the light-emitting diode LED1 to LEDn shunts the corresponding light-emitting diode LED1 to LEDn. Each of the light-emitting diodes LED1 to LEDn can be singularly jumped by means of this switch S1 to Sn, which preferably relates to a controllable and/or electronic switch, i.e. each light-emitting diode LED1 to LEDn can be cut in and cut out individually. To this end, the switches S1 to Sn are embodied as electronic switches which can be switched by the control unit 2. In a preferred embodiment, the electronic switches S1 to Sn relate to field-effect transistors and driver stages, which can be controlled and switched by the control unit 2.

The control unit 2 is supplied with a supply voltage Uv. Moreover, the control unit 2 controls a driver stage 3. The output voltage U_out of the driver stage 3 can be controlled by the control unit 2. To this end, the control unit 2 monitors the current I_out flowing through the electrical load 1 at a current measuring point 4 to which a current measuring unit is connected. The control unit 2 attempts to hold this current nearly constant by closed-loop control using the driver stage 3. The driver stage 3 is supplied by a supply voltage Ua.

The switching principle illustrated in FIG. 1 allows an arbitrary number of light-emitting diodes LED1 to LEDn connected in series to be switched on and off independently of one another. As long as the number of light-emitting diodes LED1 to LEDn in operation remains constant, i.e. as long as the number of light-emitting diodes LED1 to LEDn switched on is constant, the output voltage U_out and the output current I_out of the driver stage 3 will remain constant. In an advantageous embodiment of the invention, the control unit 2 controls the driver stage 3 using a pulse-width modulated signal Ua.

Problems will appear during operation, however, if a change is made in the light-emitting diodes LED1 to LEDn that are switched on, because the output voltage U_out of the driver stage 3 will then change, and the output current I_out, which must be driven through the light-emitting diodes LED1 to LEDn that are still switched on, therefore nearly breaks down. This problem primarily occurs when another of the light-emitting diodes LED1 to LEDn connected in series is additionally switched on. When switching on this additional light-emitting diode LED1 to LEDn, a load surge occurs. The demand for a high constancy of the luminous flux, which is directly proportional to the LED current, i.e. the current or its current intensity that flows through a light-emitting diode, is especially problematic because these interruptions clearly make themselves known especially for a short ON duration, i.e. small luminous fluxes.

To henceforth prevent these interruptions and/or minimize their effects, it is provided that another light-emitting diode LED1 to LEDn cuts in simultaneously when one of the light-emitting diodes LED1 to LEDn cuts off and vice versa.

During the initial startup of the arrangement or the initial switching on or switching off of the entire electrical load 1, the control unit 2 switches on the light-emitting diodes LED1 to LEDn of the electrical load 1 sequentially or in groups or all together.

Figure 2:
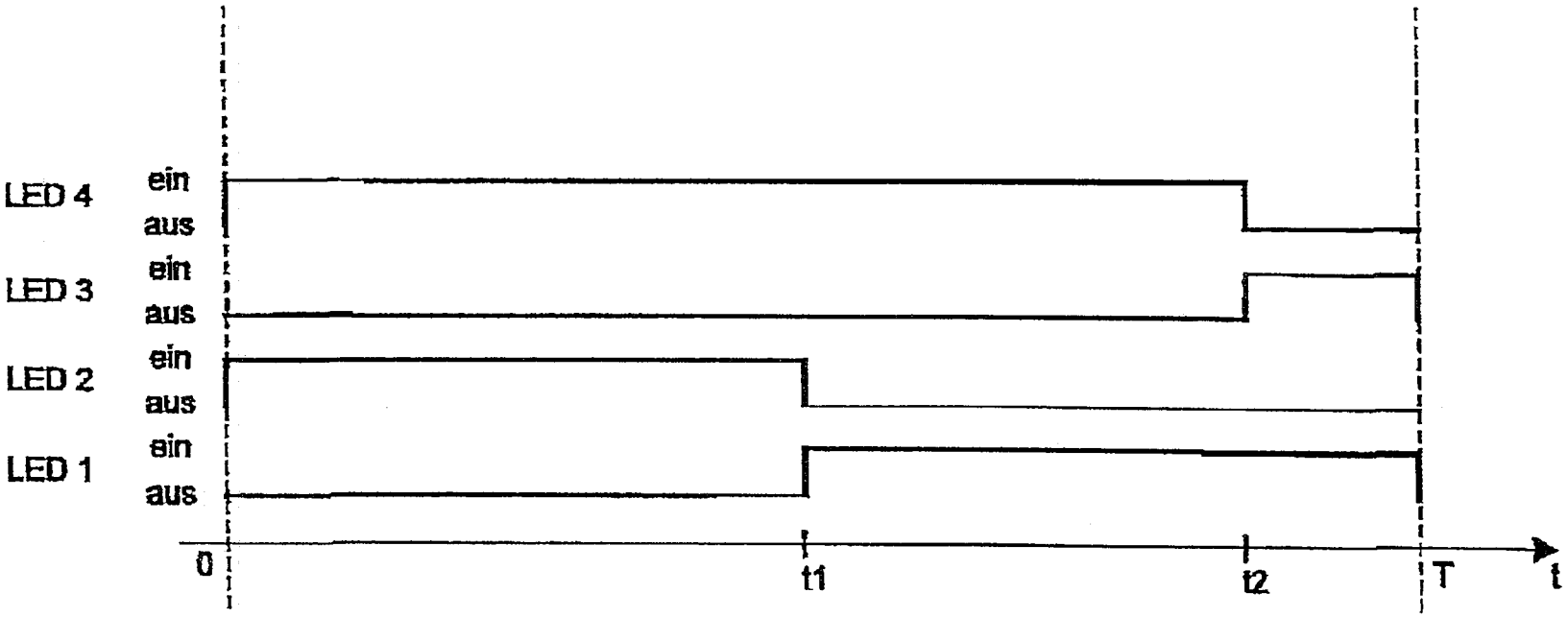
FIG. 2 is a control principle without load surge.

FIG. 2 illustrates such a control principle with prevention of a load surge.

FIG. 2 schematically illustrates four light-emitting diodes LED1, LED2, LED3, LED4, which represent the electrical load 1 of FIG. 1 for example, and the respective switching state of the light-emitting diodes LED1, LED2, LED3, LED4 switched "on" and switched "off" one above the other over a time interval 0 to T. For operation, a plurality of switching cycles T are arranged one after the other.

But this principle described below can be followed only with a number of light-emitting diodes LED1 to LEDn from FIG. 1 whose ON durations, expressed as percentages, add up to an integral multiple of 100%. FIG. 2 therefore depicts four light-emitting diodes LED1, LED2, LED3, LED4. The light-emitting diodes LED1, LED2, LED3, LED4 are switched on and off at different times. But another light-emitting diode LED1, LED2, LED3, LED4 is always simultaneously shut off when one of the light-emitting diodes LED1, LED2, LED3, LED4 is switched on. The light-emitting diode LED2 is switched on at time 0, and the light-emitting diode LED1 is shut off. The light-emitting diode LED4 is switched on and the light-emitting diode LED3 is switched off. A load surge is avoided by simultaneously switching on and switching off one light-emitting diode LED1, LED2, LED3, LED4 at a time. The load surge arising from switching on the light-emitting diodes LED2, LED4 is compensated by switching off the light-emitting diodes LED1, LED3. Contrarily switching light-emitting diodes on and off in pairs prevents the load surges that would otherwise appear. The light-emitting diode LED2 is again switched off at a later time t1. But the light-emitting diode LED1 is then switched on simultaneously. A load surge is likewise prevented in this case. To henceforth likewise prevent a load surge at a later time t2 when the light-emitting diode LED4 is to be switched off, the light-emitting diode LED3 is switched on simultaneously.

In the embodiment with the control principle as per FIG. 2, the separate light-emitting diodes LED1 to Led4 are controlled by a pulse-width modulated signal. But it is essential that two light-emitting diodes LED1, LED2, LED3, LED4 at a time be alternatingly driven in one control interval, i.e. reciprocally switched on and off, to prevent a load surge. This control principle permits flexible operation of the light-emitting diodes LED1, LED2, LED3, LED4 with a nearly constant electrical voltage. The driver stage 3 from FIG. 1 can then be designed for a maximum output voltage of U_out, which is smaller than the sum of the single voltage drops across the single loads LED1 to LEDn, which may be switched on together. But it is necessary to require that the sum of the turn-on times of all light-emitting diodes LED1 to LED4 to be switched on during a switching cycle T does not exceed a particular maximum.

But a problem arises when the sum of the turn-on times of all light-emitting diodes to be switched on during a switching cycle T does not equal an integral multiple of the cycle duration of the switching cycle T. In the embodiment according to FIG. 2, the turn-on times of the single loads LED1 and LED2 and of LED3, LED4 respectively, each fill the entire cycle duration. The desired current therefore remains constant.

Figure 3:
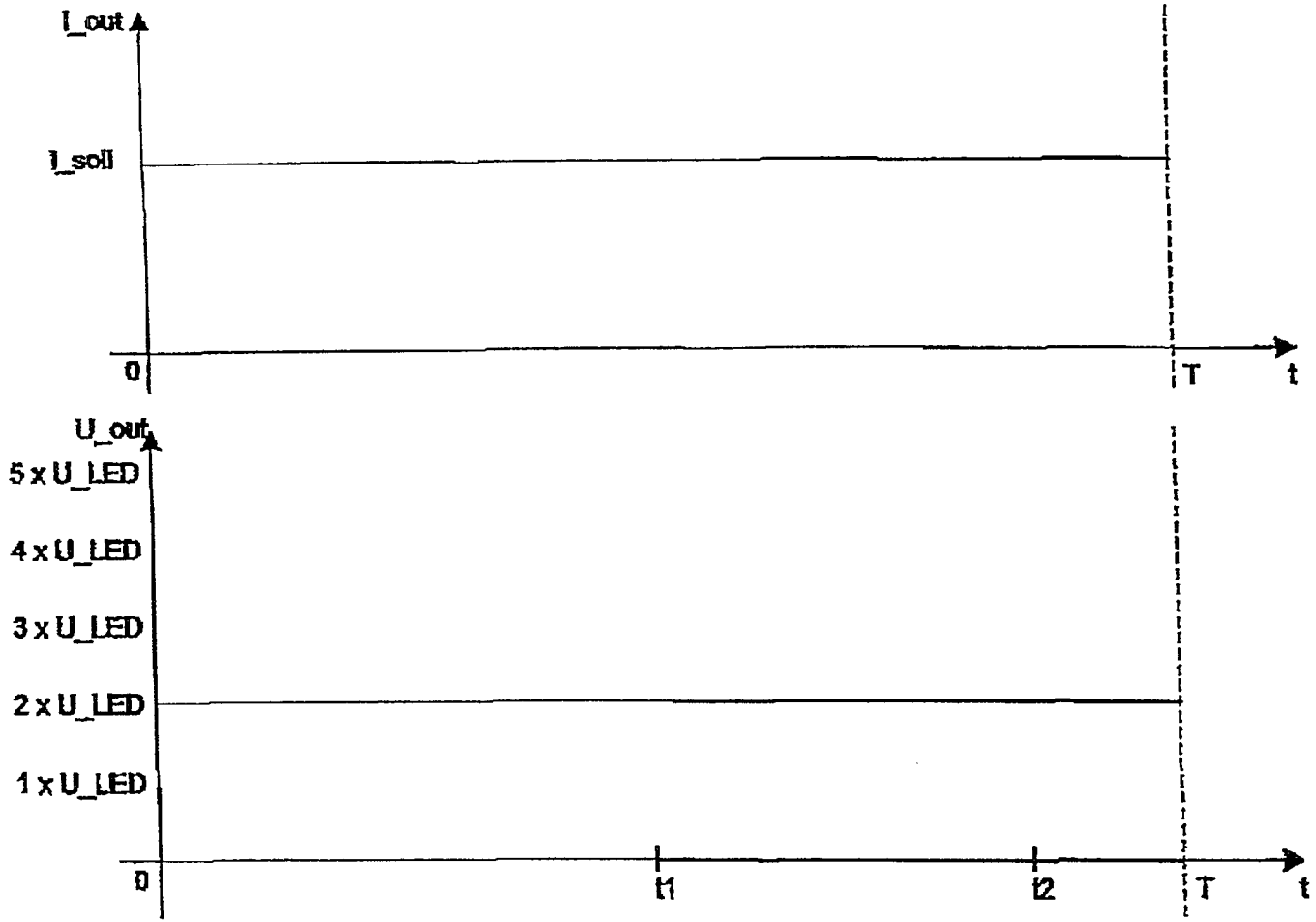
FIG. 3 is the current curve and voltage curve without load surge.

FIG. 3 depicts the electrical voltage, which drops across the electrical load 1 and thus across the single loads LED1 to LED4 from FIG. 2, as voltage value U_out over the switching cycle T. The voltage U_out in FIG. 3, which is provided by the driver stage 3, corresponds to the voltage drop across the switched-on light-emitting diodes LED1 to LED4. FIG. 3 shows the curve of the current I_out, which flows through the light-emitting diodes LED1 to LED4 during one switching cycle T, above the voltage U_out. Since two light-emitting diodes at a time are switched on over the entire cycle duration of the switching cycle T in FIG. 2, the voltage U_out amounts to the sum of the two partial voltages that each drop across one of the light-emitting diodes LED1 to LED4. The current I_out, which flows through the light-emitting diodes, is likewise constant. The simultaneous switching of two light-emitting diodes on and off prevents a load surge, which is connected with a voltage rise and a current break. The driver stage 3 hardly has to correct. Flickering is prevented. FIG. 3 illustrates that no variation of the desired current I_desired and electrical voltage U_out arises at the cut-in points t1, t2.

Figure 4:
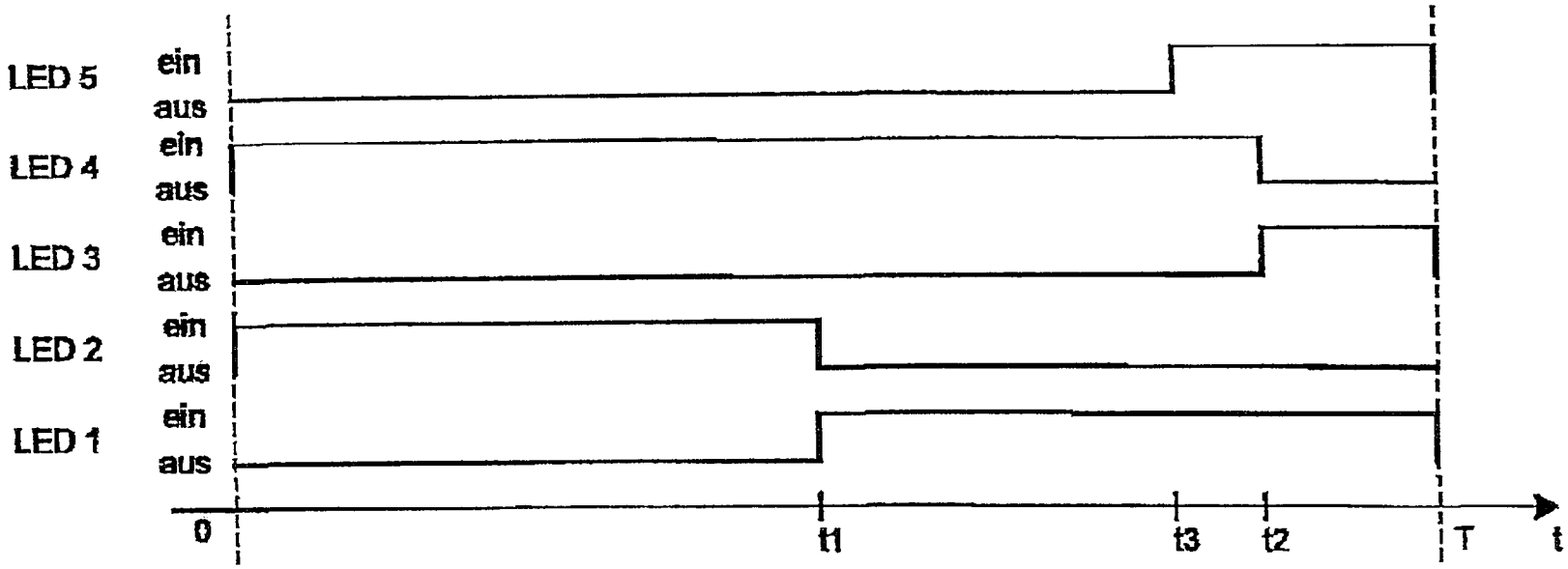
FIG. 4 is a control principle with load surge.

FIG. 4 schematically illustrates five light-emitting diodes LED1, LED2, LED3, LED4, LED5 one above the other and their respective switching states of switched "on" and switched "off" over a switching cycle T. In contrast to the embodiment in FIG. 2, the sum of the ON durations of the light-emitting diodes LED1 to LED5 expressed as percentages is not an integral multiple of 100%. The problem of a load surge now arises if another light-emitting diode, namely the light-emitting diode LED5, is to be switched on or off and no other light-emitting diode can be switched contrarily. If the light-emitting diode LED5 is now to be switched on, e.g. at time t3, then a load surge will arise. FIG. 4 depicts this. The light-emitting diodes LED1 to LED4 are switched on and off similarly as in the embodiment of FIG. 2, without load surge.

Figure 5:
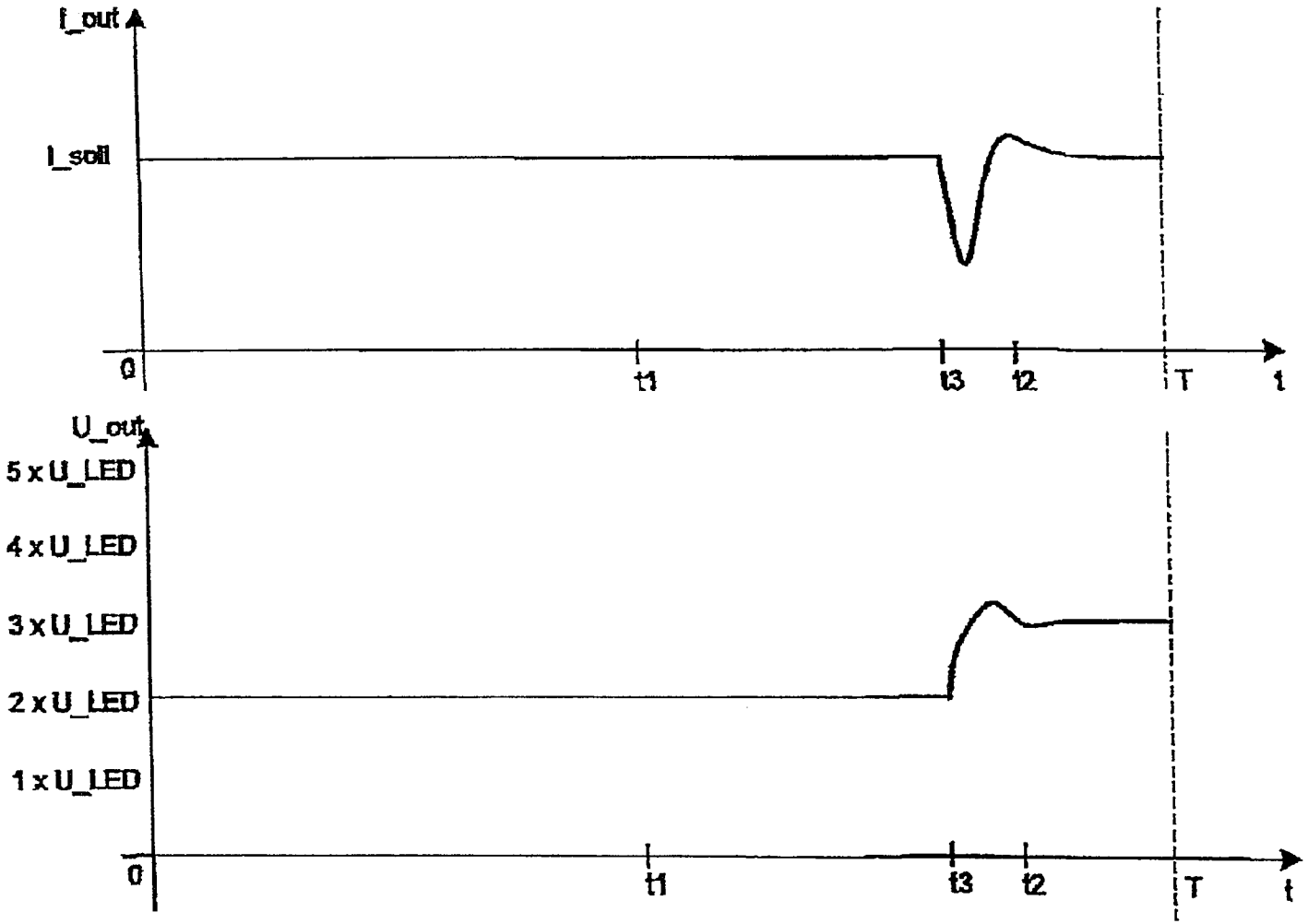
FIG. 5 is a transient response when cutting in an LED.

FIG. 5 illustrates the effect on the voltage and current curves caused by switching on the light-emitting diode LED5 at time t3.

FIG. 5 illustrates the voltage U_out and the current I_out versus time within one switching cycle T. As now quite evident, the current I_desired dips at time t3, the time at which the light-emitting diode LED5 is switched on. The voltage U_out rises by more than one LED forward voltage and then levels off at the new voltage value. In a certain period the current I_out also levels off again to the setpoint I_desired. Switching on the light-emitting diode LED5 thus generates a load surge at time t3. The output voltage U_out of the driver stage 3 now divides itself to the active light-emitting diodes LED1, LED4, LED5. Since the voltage U_out applied to the separate active light-emitting diodes LED1, LED4, LED5 has dropped, a smaller current I_out flows through the active light-emitting diodes LED1, LED4, LED5 in correspondence to the voltage-current characteristic of the light-emitting diodes LED1, LED4, LED5. The control unit 2 now corrects the current I_out back to the target level and the output voltage U_out rises until the desired current reestablishes itself. The correction to the new voltage value takes place more or less quickly with corresponding transient response, independently of the technical design of driver stage 3. This causes flickering on the light-emitting diodes LED1, LED4, LED5.

But it is essential that the interruption of the current I_out in this case affects not only one, but all of the light-emitting diodes LED1, LED4, LED5 that are driven and active at this time. The effect is all the more strongly observed, the fewer light-emitting diodes are driven at the same time. If, for example, another light-emitting diode is switched on when operating ten light-emitting diodes, which corresponds to a voltage of ten times 2.5 V and therefore a total voltage of 25 V, so that eleven light-emitting diodes are then switched on, the applied voltage of 25V first divides itself in equal parts to all eleven single loads when the eleventh light-emitting diode is switched on so that the voltage on each light-emitting diode then drops to 2.27 V. The current flowing through each of the light-emitting diodes then reduces itself in correspondence with the voltage-current characteristic. If this scenario is observed with a change from one to two light-emitting diodes, then only 1.25 V is applied to each light-emitting diode, a result which is actually tantamount to an interruption of the current. The light-emitting diodes are then at first dark and quasi shut off for a user.

Since each change in the current is associated with a corresponding change in brightness of the light-emitting diodes, the transient phenomenon means a deviation in the desired brightness when the voltage subsides in the case of a voltage surge. This effect is all the stronger, the shorter the ON duration of the light-emitting diodes switched on in the transient region, i.e. in the period that control unit 2 requires to correct the driver stage 3 back nearly to the desired current.

Figure 6:
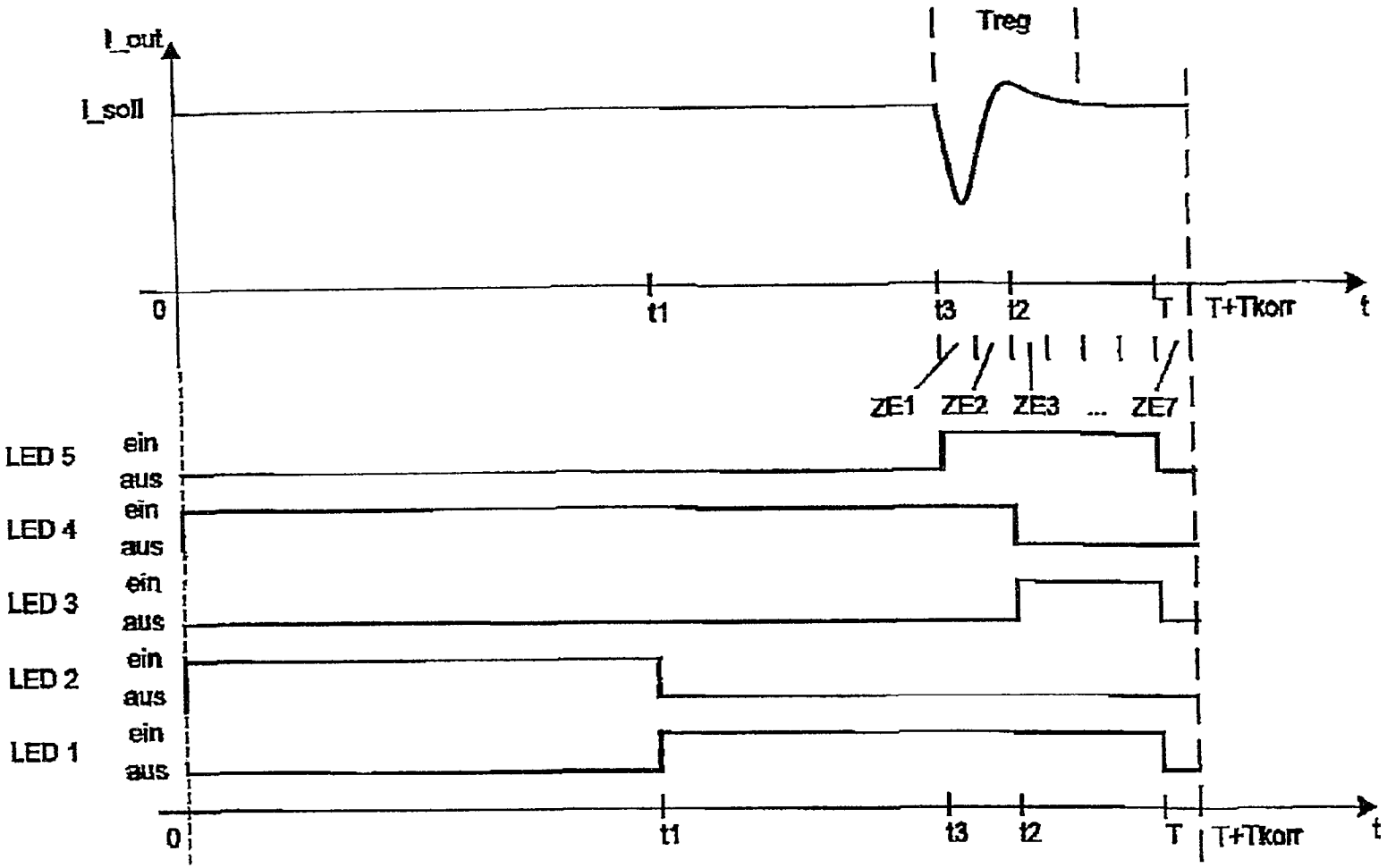
FIG. 6 is a schematic representation of the states of LEDs and the current curve versus time.

FIG. 6 illustrates the current I_out, which flows through the electrical load 1, similarly to FIG. 5. It also depicts the states of the light-emitting diodes LED1 to LED5, switched on or switched off. The illustration in FIG. 6 is in the form of a curve over time t. It is evident that the current flow I_out dips at time t3 due to the switching-on of light-emitting diode LED5 and that a known period of time Treg is needed before the current I_out is again adjusted nearly to the setpoint. In the time interval t3+Treg, a smaller current I_out therefore at first flows through the switched-on and illuminating light-emitting diodes LED1, LED4, LED5 in this period, so that their light output is reduced. In the further course of events, there arises a current excess due to the control response. A visible change in brightness therefore occurs to the user. This change in brightness is noticed as flickering. The flickering is still reinforced when the turn-on times of the light-emitting diodes LED1 to LED5 shift within the transient region, e.g. by switching on additional light-emitting diodes LED1 to LED5 or by changing the ON durations of light-emitting diodes LED1 to LED5.

A switching cycle T corresponds to time interval 0 to T. The duration of a switching cycle T is thus chosen so short, e.g. 20 ms, that it is no longer perceptible to the human eye. But the current interruption makes the flickering perceptible. To compensate for this flickering and make it nearly invisible to the human eye, a correction period Tcorr is added to each switching cycle T in which an interruption of the current I_out occurs. The switching cycle T is thus extended by this correction period Tcorr. The correction time Tcorr maximally corresponds to the time duration Treg that is needed to compensate for the current break. In a preferred embodiment of the invention, the correction period Tcorr is however chosen shorter than the period Treg. It must namely be taken into consideration that a slight overswinging of the current intensity I_out will occur due to the correction of the current I_out. FIG. 6 likewise depicts this. This overswinging brings the light-emitting diodes LED1, LED3, LED4 and LED5, which are switched on at this time, to a somewhat stronger light output. When the desired current I_out again rises, the switched-on light-emitting diodes LED1, LED3, LED4 and LED5 briefly illuminate somewhat brighter as a result of the slight excess of the current I_out. Taking this into consideration, it is possible to adjust or correct the entire light output of the light-emitting diodes that illuminate in the switching cycle T for the human eye over the added correction period Tcorr by which the switching cycle T is then extended, in compensation for the brightness emission over the switching cycle T. Extending the switching cycle T effectively compensates for the defect in the brightness emission of the light-emitting diodes LED1 to LED5.

As explained, only the light-emitting diodes LED1 to LED5 that are switched on at time t3 to t3+Treg are affected. It is henceforth essential to know in advance the times at which the affected diodes are switched on and off. Control unit 2 controls the light-emitting diodes in a switching cycle T. Before each switching cycle T, the control unit 2 therefore knows when which of the light-emitting diodes LED1 to LED5 will be switched on and off. The time position of the control deviation within switching cycle T is therefore also known and a selective intervention by control unit 2 can occur. The ON durations of the light-emitting diodes LED1 to LED5 that are switched on in the time interval Treg are now modified to compensate for the change in brightness caused by the current break. To this end, it is first necessary to quantify the reaction of the closed-loop control circuit control unit 2 and driver stage 3 for a defined load variation in the entire load range. From this result and from knowledge of the individual characteristic curves of the light-emitting diodes LED1 to LED5, it is possible to determine in advance the expected brightness difference in the time interval Treg. In an advantageous embodiment of the invention, the control unit 2 calculates the change in brightness emission on the basis of the voltage-current characteristics of the light-emitting diodes LED1 to LED5. It is particularly advantageous to divide the switching cycle T into time units ZE of identical length. This is advantageous above all in the period starting with the time interval Treg until the end of the switching cycle T.

FIG. 6 depicts the switching cycle T+Tcorr, starting with the current break of the current I_out at t3, divided into such time units ZE. This period is divided into seven time units of equal length labeled ZE1 to ZE7. In FIG. 6, the length of one time unit ZE1 to ZE7 corresponds to the period Tcorr.

Whether a correction must be made by extending or reducing the ON duration depends on the time at which the light-emitting diodes LED1-LED5 are switched on or off and the position of the current break. In FIG. 6, the light-emitting diodes LED1, LED3, LED4, LED5 are affected by the current break and the current correction. Their ON durations must be corrected accordingly. The corrections take place either by extension or reduction, depending on what time the light-emitting diodes LED1, LED3, LED4, LED5 are switched on.

In this connection, a time unit ZE1 to ZE7 represents the unit of correction possibility. The shorter the time units are chosen, the more finely the time range can be resolved and the more exact a correction can be made.

Depending on the transient characteristic, the position of the turn-on and turn-off times and the number of light-emitting diodes LED1-LED5 to be controlled, it may be necessary to vary the cycle duration of a switching cycle T, i.e. to extend or reduce it. The control therefore always takes place taking all corrections under consideration in the context of the maximum possible cycle duration of a switching cycle T, which must then be extended or reduced by the maximum period Tcorr. The period Tcorr is the computationally or meteorologically determined maximum period needed to correct the current break and adapt the brightness emission of all light-emitting diodes.

At an appropriate performance capability of the control unit 2 and control speed of the driver stage 3, it is also possible to determine the correction values for the time units ZE1-ZE7 dynamically and calculate them for each individual switching cycle.

In another advantageous embodiment of the invention, the control unit 2 increases the output voltage of the driver stage 3 before switching on a light-emitting diode that will trigger a load surge. In this manner, a correction is already started before a load surge appears. The more performance-capable the driver stage 3 and the faster it can execute and adjust a voltage increase, the smaller the temporal correction measures will turn out.

In the case of light-emitting diode LED2, there is no need for correction because light-emitting diode 2 was switched off during the current break and is not active.

An extension of the ON duration by two time units ZE is necessary for the current break, and a reduction of the ON duration by one time unit ZE is necessary because of the succeeding overswing, so that a duration of one time unit ZE results for Tcorr.

The correction values for the light-emitting diodes LED1 and LED5 each amount to one time unit ZE since the entire transient phenomenon of correcting the current break I_out lies in the control range of both light-emitting diodes LED1 and LED5. The light-emitting diode LED4 must be corrected by two time units because the current break takes place completely during the switched-on state of this light-emitting diode LED4, over nearly two time units ZE1 and ZE2 as per FIG. 6. Without this corrective intervention over two time units ZE1 and ZE2, the light-emitting diode would emit too little light over the entire switching cycle T. The light-emitting diode LED3 is corrected by one time unit ZE. The ON duration of the light-emitting diode LED3 is reduced by one time unit ZE. This is necessary since the light-emitting diode is switched on exactly at time t2 when the current excess occurs so that the light-emitting diode LED3 would consequently emit too much light if activation were not corrected.

Figure 7:
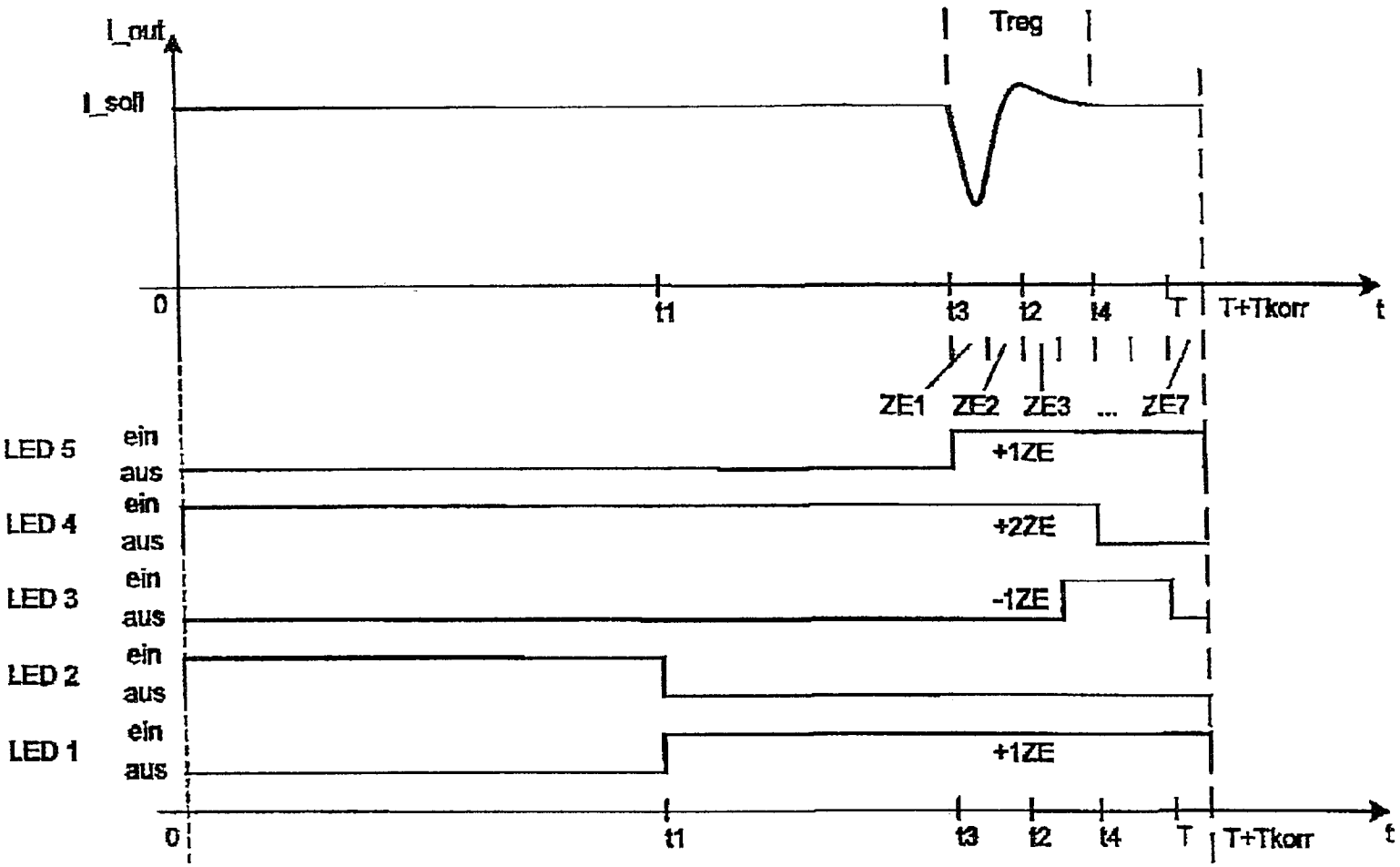
FIG. 7 is another schematic representation of the states of LEDs and the current curve versus time.

FIG. 7 shows the switching states and ON durations of the light-emitting diodes LED1 to LED5 with the cited corrections. This correction, however, shifts the turn-on and turn-off times and thereby causes other load surges to appear. In FIG. 7, a further such load surge would appear at time t2, because the former compensation of the load surge that would have arisen when switching on LED3 was compensated by simultaneously switching off LED 4. In FIG. 7, this would henceforth no longer be the case, because LED4 would be cut off only at time t4. The turn-on times within one switching cycle T are therefore shifted according to the offset of the correction values so that no offset of the turn-on times relative to each other will occur and that no other load surge will therefore arise. This measure also guarantees that all light-emitting diodes LED1-LED5 will cut off simultaneously at T+Tcorr. In the concrete example embodiment as per FIG. 6 and the correction as per FIG. 7, a reduction of the ON duration is necessary only for the light-emitting diode LED3.

Figure 8:
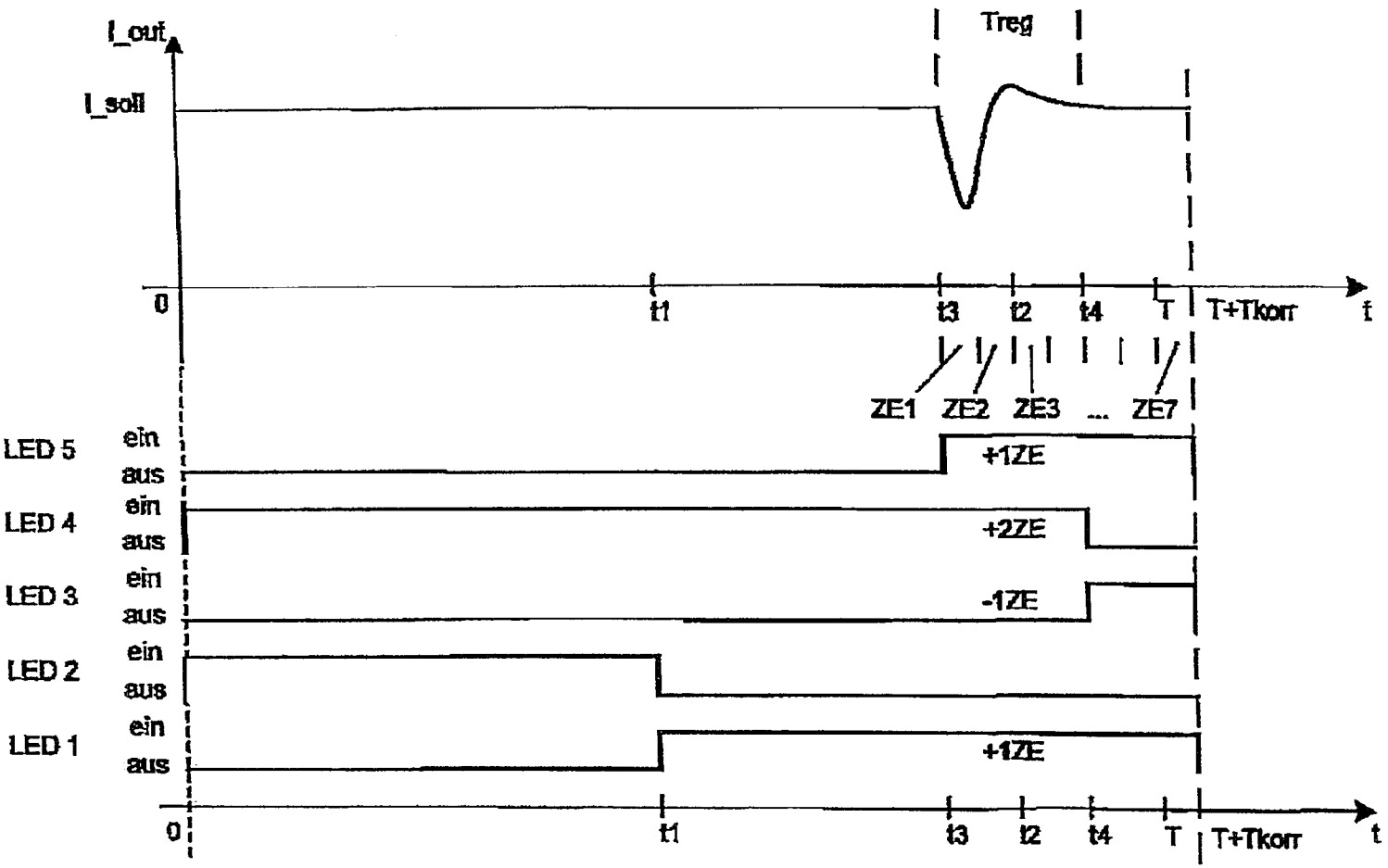
FIG. 8 is another schematic representation of the states of LEDs and the current curve versus time.

In FIG. 8, these shifts are taken into consideration and the switching edges are adapted so that the switching points are optimized. It henceforth follows that the clever shifting of the turn-on and turn-off times of the light-emitting diodes LED3 and LED4 in FIG. 8 prevents a load surge, which in FIG. 7 would have arisen when switching on the light-emitting diode LED3. The temporal additional correction of the ON and OFF duration of light-emitting diodes LED1-LED5 compensates for the load surge that occurs when switching on the light-emitting diode LED5 at time t3. The extension or reduction of the ON duration of light-emitting diodes LED1 to LED5 makes it possible to minimize the brightness fluctuations. Moreover, a clever adaptation of the turn-on and turn-off times of the light-emitting diodes LED1 to LED5 makes it possible to prohibit load surges and prevent flickering. The shorter the times units chosen for the correction, the more precise a compensation is possible and thus a prevention of brightness fluctuations.

The method is particularly inexpensive because it can be implemented on components already used and introduced without additional components.

LIST OF REFERENCE CHARACTERS

LED1 . . . LED5—single load
S1 . . . Sn—controllable switch
UV—supply voltage
U_in—input voltage
U_out—output voltage
Ua—current potential
I_out—output current
I_desired—desired current
1—electrical load
2—control unit
3—driver stage
4—current measuring point
ZE1 . . . ZE7—time units
T—switching cycle
Tcorr—correction period
Treg—control period
t1, t2, t3, t4—times The principle and mode of operation of this invention have been explained and illustrated in its preferred embodiment. However, it must be understood that this invention may be practiced otherwise than as specifically explained and illustrated without departing from its spirit or scope.

What is claimed is:

1. Method for controlling an electrical load consisting of at least two single loads connected in series by means of switching cycles of predefined duration sequentially following one another, wherein a controllable switch is connected in parallel to each single load so that each single load is switched independently of the other single load in the switching cycle, wherein the electrical current, which is supplied by a driver stage and flows in the electrical load, is monitored and, by means of a target-performance comparison, adjusted to an adjustable setpoint by a control unit within the switching cycle, so that a current that is substantially constant flows in the electrical load and, by means of the controllable switch, the control unit switches each of the single loads on and off within the switching cycle at predefined turn-on and turn-off times, characterized in that:

in the switching cycle in which the number of single loads to be switched on and the number of single loads to be switched off are equal, one single load is switched on and another single load is simultaneously switched off, or in the switching cycle in which the number of single loads to be switched on is larger than the number of single loads to be switched off, the switching cycle is extended by a correction period, wherein the correction period substantially corresponds to the period that the control unit is to correct the output current of the driver stage to the desired current in case of a load surge arising from switching on the single load without switching off another single load at the same time, and the time positions of the predefined turn-on times and turn-off times of the single loads are then varied or remain the same or their ON times are extended or reduced or else remain the same as a function of the time of the load surge in the switching cycle.

2. Method according to claim 1, characterized in that even when no load surge occurs, the switching cycle is extended by the correction time so that the ON durations, expressed as percentages, of the single loads that are not affected by the correction procedure remain the same.

3. Method according to claim 1, characterized in that the switching cycle from the beginning of a load surge until the end of the switching cycle is divided into time units and that the adaptation of the turn-on and turn-off times is based on the time units.

4. Method according to claim 1, characterized in that the time units have the same period.

5. Method according to claim 1, characterized in that the time units correspond to an identical energy.

6. Method according to claim 1, characterized in that the duration of the activation of a single load is extended or reduced as a function of the time position of the load surge during the switched-on state of the single load.

7. Method according to claim 1, characterized in that the initial switching on and/or the switching off of the at least two single loads of the electrical load occurs individually, sequentially or together or in groups.

8. Method according to claim 1, characterized in that the electrical current flowing in the electrical load is monitored at a current measuring point by a current measuring unit and adjusted to an adjustable setpoint using a target-performance comparison, wherein the control unit uses the driver stage to perform closed-loop control so that a current that is substantially constant flows in the electrical load.

9. Method according to claim 1, characterized in that a single load is formed by a diode array consisting of a light-emitting diode or at least two light-emitting diodes connected in parallel and/or connected in series and/or matrix-connected.

* * * * *